US009523468B2

(12) United States Patent
Donegan et al.

(10) Patent No.: US 9,523,468 B2
(45) Date of Patent: Dec. 20, 2016

(54) LIGHTING FIXTURE HAVING ENHANCED LIGHT DISTRIBUTION PERFORMANCE

(71) Applicant: SIMPLY LEDS, LLC., Garden City, ID (US)

(72) Inventors: Daniel Donegan, Garden City, ID (US); Robert Deely, Garden City, ID (US); George Taylor, Garden City, ID (US); Charles Wilkerson, Garden City, ID (US)

( * ) Notice: Subject to any disclaimer, the term of this patent is extended or adjusted under 35 U.S.C. 154(b) by 171 days.

(21) Appl. No.: 14/458,115

(22) Filed: Aug. 12, 2014

(65) Prior Publication Data

US 2015/0043206 A1 Feb. 12, 2015

Related U.S. Application Data

(60) Provisional application No. 61/864,805, filed on Aug. 12, 2013.

(51) Int. Cl.

| | |
|---|---|
| ***F21V 29/00*** | (2015.01) |
| ***F21K 99/00*** | (2016.01) |
| ***F21V 7/04*** | (2006.01) |
| *F21Y 111/00* | (2016.01) |

(52) U.S. Cl.

CPC . *F21K 9/50* (2013.01); *F21K 9/54* (2013.01); *F21K 9/60* (2016.08); *F21K 9/62* (2016.08); *F21V 7/048* (2013.01); *F21V 29/004* (2013.01); *F21V 29/2212* (2013.01); *F21Y 2107/00* (2016.08); *F21Y 2111/001* (2013.01); *F21Y 2115/10* (2016.08)

(58) Field of Classification Search

CPC ..... F21V 29/2268; F21K 9/54

See application file for complete search history.

(56) References Cited

U.S. PATENT DOCUMENTS

| | | | | |
|---|---|---|---|---|
| 2011/0228550 | A1* | 9/2011 | Robinson | F21V 29/506 362/555 |
| 2011/0249441 | A1* | 10/2011 | Donegan | H05B 33/0803 362/253 |
| 2012/0039073 | A1* | 2/2012 | Tong | F21V 7/0008 362/231 |
| 2012/0051054 | A1* | 3/2012 | Kauffman | F21S 8/08 362/249.02 |
| 2012/0051055 | A1* | 3/2012 | Kauffman | F21V 19/001 362/249.02 |
| 2013/0322074 | A1* | 12/2013 | Guercio | F21V 29/002 362/235 |

* cited by examiner

*Primary Examiner* — Elmito Breval

(74) *Attorney, Agent, or Firm* — Robert L. Shaver; Shaver & Swanson, LLP

(57) ABSTRACT

An LED lighting fixture with a heat sink, LED arrays on angled facets, a reflector dish, and a diffuser lens are disclosed. The LED arrays are mounted at an angle on sloped facets, and the reflector intercepts a portion of light from the LED arrays, and redirects the intercepted light downward, resulting in a focused and collumnated light beam. Very little light is allowed to be projected upward above the light fixture, and less light is dispersed to the side.

13 Claims, 2 Drawing Sheets

LIGHTING FIXTURE HAVING ENHANCED LIGHT DISTRIBUTION PERFORMANCE

PRIORITY/CROSS-REFERENCE TO RELATED APPLICATIONS

This application claims the benefit of U.S. Provisional Application No. 61/864,805, filed Aug. 12, 2013, the disclosure of which is incorporated by reference.

TECHNICAL FIELD

The present invention relates generally to lighting fixtures and luminaires, and more particularly, relates to a lighting fixture having enhanced heat sink performance with a heat sink member that attaches diffusers, internal reflectors and inserts to enhance light distribution for various applications.

BACKGROUND

Today many companies are offering decorative outdoor light emitting diode (LED retrofit kits and new LED fixtures in order to take advantage of the long life, excellent color and beam control and other benefits of LEDs. LEDs are temperature sensitive and generate a significant amount of heat, which must be removed from the fixture in order to assure long life and adequate illumination.

To date, most manufacturers have placed LEDs on heat sinks or printed circuit boards, which are either inside the optical and/or housing area or are mounted to an opaque metal top to provide heat extraction from the fixture. The problem with these designs is the high thermal resistance from LED heat source to the outside ambient air. Much of the heat remains trapped inside the optical cavity and lowers the life expectancy of the LED and limits the wattage of the LED light engine. Therefore, the life expectancy and total lumen package is less than is required for many applications. To date, no solution has been developed to provide for enhanced thermal performance with the light fixture having an external heat sink while incorporating several features to improve luminous light output or dispersion and directional control in many different application settings.

High power LED arrays are also very bright and it is both unappealing in many applications and, due to glare, poor for visibility where the individual LED array are visible as points of light. The use of LED arrays and a specially designed diffuser and the directional application of the LED arrays through an internal specially shaped reflector and various inserts minimizes glare and enhances aesthetic design and distribution of light.

A need exists for a new lighting fixture that employs features for improved heat dissipation and improved light distribution.

SUMMARY OF THE DISCLOSURE

Disclosed is a LED light fixture which has a top side and a bottom side. The top side is basically pointing toward the ceiling when it is mounted on the inside of a building, and the bottom side is pointed toward the floor of the building. When mounted in a parking lot or in an outdoor situation, the light fixture would typically have the top side pointing to the sky and the bottom side pointing toward the ground. The light fixture is made up of a body which includes a heat sink ring with outwardly radiating fins. The heat sink ring would typically be a metal such as aluminum, and would be ring like with outwardly radiating fins. The purpose of the heat sink ring is to absorb heat from the LED arrays, which are mounted adjacent to the heat sink ring, and to radiate the heat through the radiating fins to keep the LED arrays and the electronics from overheating and shortening their life.

The device includes an attachment means, which can be a place where a mounting bracket is screwed into the top side of the light fixture, or it can be a place where an arm such as from a light pole screws into the top or side of the light fixture body with bolts. Other attachment means are possible such as a U bracket, loop or D ring which is hung from hooks or otherwise attached to a ceiling or light pole.

The inside surface of the heat sink ring is comprised of a number of sloped planar facets, forming a polygonal inside surface of the heat sink ring, with each polygon sloped slightly from the vertical to direct the light from the LEDs towards the bottom side of the light fixture. The LEDs would be present in arrays of LEDs which are attached to the inside surface of the heat sink ring. Adjacent to the heat sink ring and the LED light arrays is a reflector dish which is attached to the fixture body. The reflector dish is smaller in diameter than the inside diameter of the heat sink ring, and is placed approximately level with the LED light arrays. The outside surface of the reflector dish is sloping in relation to the LED arrays, so that light from the LEDs strikes the reflector dish and is reflected in a downward direction, toward the bottom side of the light fixture. The light fixture further includes a diffuser lens which is frosted or prismatic or having other surface angles to help diffuse the light coming from the LED light arrays. One version of the diffuser lens can have sloping sides, which slope toward the center of the light fixture, with a flat bottom. The diffuser lens can be made of any translucent or transparent material, and plastic is a practical material for use in the diffuser lens.

One version of the reflector dish is generally shaped like a portion of a sphere, with a rim around the base and the reflector dish curving in a general spherical shape. Another version of the reflector dish is one in which the dish is generally shaped like an inverted pie pan, with a flat bottom. The sides of this reflector dish are generally sloped, and are formed into flat facets, which are positioned to correspond with the facets on which the LED arrays are placed. In this way, each LED array is facing the facet of the pie pan reflector dish, which causes light to be reflected toward the bottom side of the light fixture and away from the top side. In this manner, very little light is directed upward from the light fixture and most of the light is directed in a downward fashion from the light fixture. The light from the LED arrays is columnated, so that it is less diffuse when it strikes a surface which may be a long distance below the light fixture. This results in more light hitting the area under the light fixture, or less power expended on delivering the same lumens onto the surface below the light.

BRIEF DESCRIPTION OF THE DRAWINGS

The present invention together with the above and other objects and advantages may best be understood from the following detailed description of the preferred embodiments of the invention illustrated in the drawings, wherein.

DESCRIPTION OF PREFERRED EMBODIMENTS

In accordance with features of the invention, a lighting fixture having an enhanced light distribution technology is disclosed.

Figure 1:
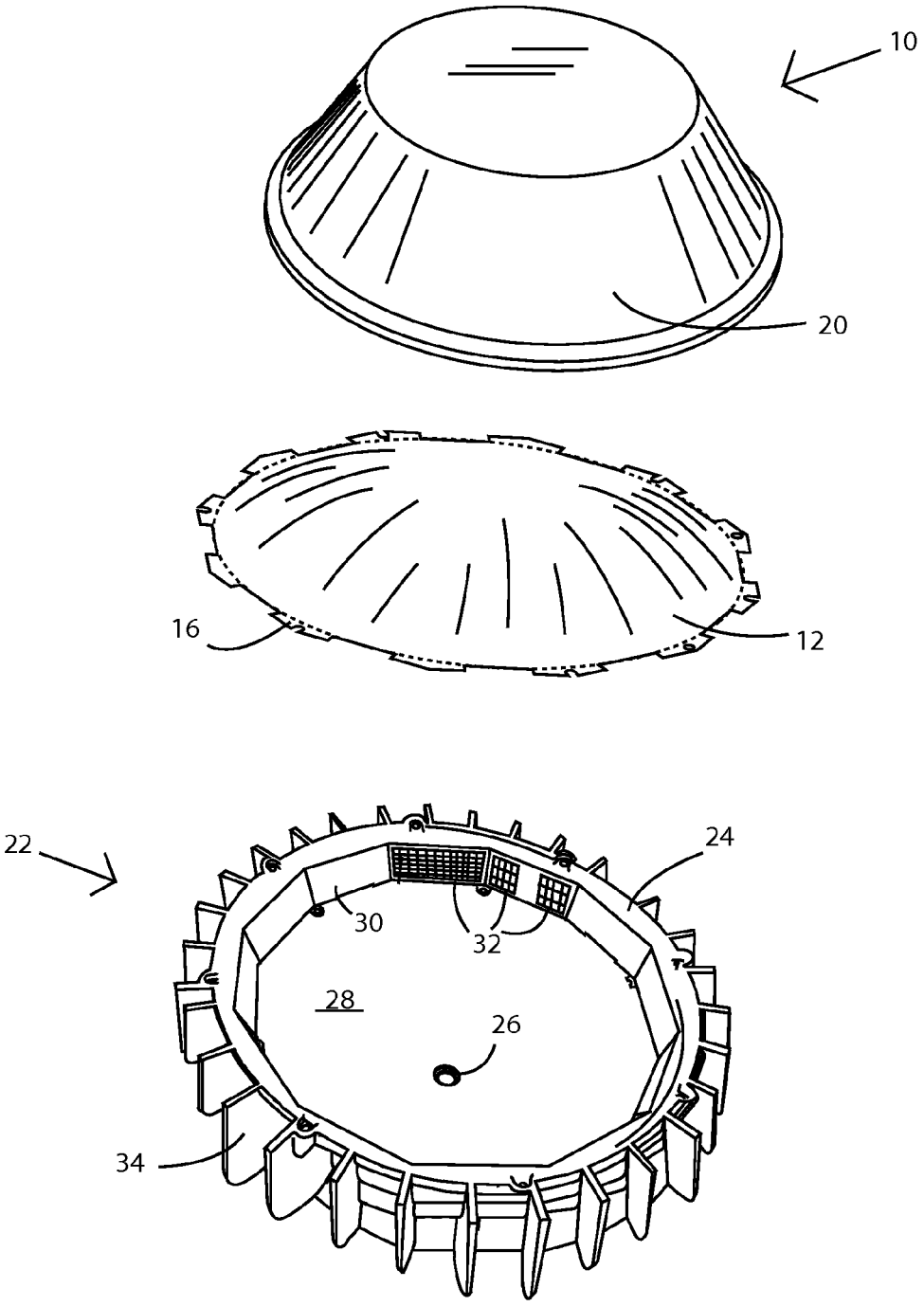
FIG. 1 is an exploded view of a light fixture of the disclosed technology.
Figure 2:
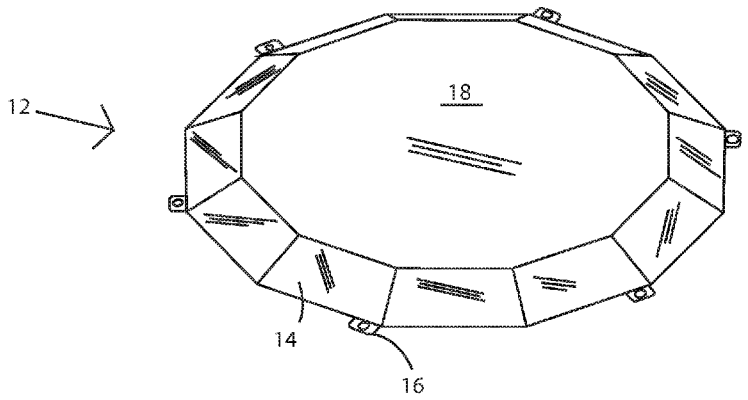
FIG. 2 is a perspective view illustrating a reflector dish of the disclosed lighting fixture technology.
Figure 3:
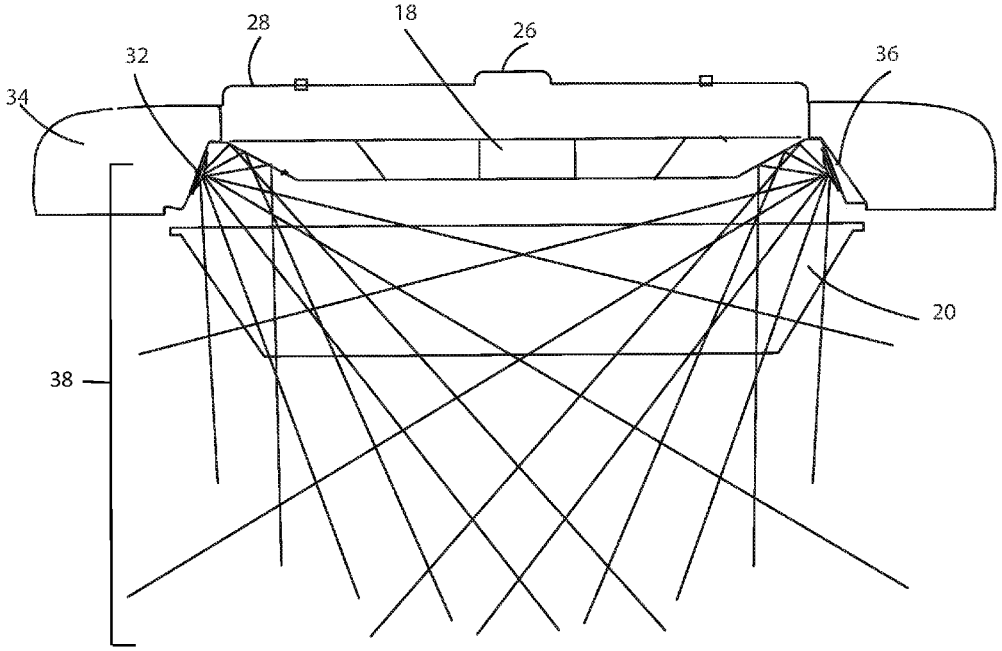
FIG. 3 is a side view of a light fixture of the disclosed technology, showing light pathways emanating from LED array light sources and the reflector dish shown in FIG. 2.

The lighting fixture of the disclosed technology is shown in FIGS. 1 through 3. Shown in FIG. 1 is an exploded view of the disclosed lighting fixture. Shown are a diffuser lens 20, a reflector dish 12, a light fixture body 22, and a heat sink ring 24. The fixture body 22 has an inside surface 28, an attachment means 26, sloped planar facets 30, to which LED arrays 32 are attached. The heat sink ring 24 has radiating fins 34, which are radial from the center of the round fixture, and which conduct and radiate heat from the LED arrays.

The light fixture body 22 of FIG. 1 can be made to various sizes, but a size for typical installation would be approximately 20 inches in diameter of the heat sink 24, and about 4 inches in thickness of the light fixture body 22. The heat sink ring 24 and the light fixture body 22 can be one unitary piece. On the inside surface of the heat sink ring 24 are sloped planar facets 30, to which LED arrays 32 are placed. Since the light emanating from a single LED array exits the LED array in approximately a 120 degree hemispherical spread, by the LED arrays being at an angle, most of the light is directed to the center of the fixture, with some of the light being directed straight down from the light fixture. These light fixtures are typically placed in an overhead manner such as on the ceiling of a large indoor space such as a warehouse or a big box store. They can also be placed on a pole in a situation such as a parking lot, or can be mounted from a structure such as the side of a building or under a freeway overpass.

The heat sink ring 24 is typically one solid piece of aluminum, which has fins 34 radiating out from the periphery in a radial manner. Alternatively, the heat sink ring 24 and the light fixture body 22 can be formed as separate pieces which fit together, and alternatively the radiating fins 34 can also be a separate piece which attaches to the outside of the heat sink ring 24.

Shown in FIG. 1 is one type of reflector dish 12, which is a rounded structure, which if made to accommodate the size of light fixture described above, would be approximately 15 inches in diameter. The curved dome (convex) part of the reflector is about 2 inches higher than the bottom edge of the reflector. Also shown is a diffuser lens 20, which for the fixture described above would be 15 inches in diameter, with the bottom of the dish being 4 inches lower than the heat sink ring. FIG. 1 shows inserts 36, which can be used to adjust the angle that light is reflected from the reflector dish.

FIG. 2 shows a second type of reflector dish. This reflector dish 12 uses reflector bottom side 18, which is a flat or domed (convex) surface, surrounded by a plurality of facets 14. Along the bottom edge of the reflector are attachment tabs 16, which are used to attach the reflector dish 12 to the light fixture body 22. The facets of the reflector dish are angled at an angle to the LED arrays of between 10-60 degrees, and optimally are between 20 and 30 degrees.

Shown in FIG. 3 is a side cross-sectional view of the light fixture of the disclosed technology, with the reflector of FIG. 2. Either type of reflector is interchangeable. Shown is a light fixture body 22 with a heat sink ring 24. On the inside surface of the heat sink ring 24 are sloped planar facets 30. On these are mounted LED arrays 32, with one or more LED arrays per planar facet 30. Mounted centrally to the heat sink ring is a reflector dish 12 which in this case is one with angled facets 14 around the periphery. Another type of reflector dish 12 could be that shown in FIG. 1, which is curved but is mounted in the same position as that shown in FIG. 3. Heat sink ring 24 has radiating fins 34 around its periphery which extend outward and radiate heat away from the LED arrays 32. Also shown is a diffuser lens 20. The diffuser lens 20 would preferably be made of a plastic or other transparent or translucent material, with surface patterns such as grids, prisms, ridges or peaks and valleys, to help disperse the light.

The light fixture body also has an attachment means 26. One means of attachment would be for 26 to include a threaded opening so that a mounting post or electrical conduit can extend into the threads of the light fixture body and lock in place with a nut which goes on the threads of the pipe or conduit. Wiring would come through the conduit and provide electrical energy to the LED arrays.

The LED arrays 32, such as Bridgelux BXRA 50C1100, are driven at 500 ma each with a total of 11 watts, not including the power supply. The fixture efficacy or lumens per watt for the lighting fixture with these LEDs is greater than 80 lumens per watt. The optical efficiency of the lighting fixture is greater than 80%.

The ring shaped heat sink member is suited for dissipating at least 300 watts of heat, in an ambient temperature of 25 degrees C. and resulting in a maximum case temperature of 65 degrees C. on the above LED arrays 32. The device can include wedge shaped inserts which may be placed on the surface of the sloped planar facets 30. LED arrays 32 are placed on the inserts, with the inserts thus changing the direction of light leaving the LED arrays 32. Typical inserts would be wedge shaped devices, approximately as wide as the sloped planar facets, or about 3 inches wide, and 1.5 inches tall.

There may be a plurality of inserts 36 on any or all of the sloped planar facets 30 of the heat sink member. The insert may be made of a thermally conductive material, such as aluminum and is either painted or anodized to protect the insert from corrosion.

The reflector dish is in the direct path of a portion of the light emitted from the LED array 32 and directs more of the light in the downwardly direction than would occur without the reflector dish. The reflector dish is made from a highly reflective aluminum member. The reflector dish is positioned to intercept part of the light from the LED arrays, and redirect it downward. The reflector may be those shown, or could be a ring of angled units, or could be individual units set up in front of each LED array. The LED arrays can be thought of as putting out light in a hemispherical field, with about 60 degrees of light to one side of a center or perpendicular plane, and 60 degrees of light on the other of the center plane. The reflector dish is positioned to intercept, reflect and redirect the light on the upward side of the plane, which is about 25-35% of the light from the LED array, by reflecting and redirecting most of the light from the upward side of the hemispherical field in a downward direction. The light on the other side of the plane continues on to the diffuser lens unimpeded. This is shown in FIG. 3 as light spread 38. The intercepted light is redirected downward and by the redirection, is more collumnated. Thus the light from the light fixture arrives at the ground below the fixture in a more focused beam, with less light dispersed to the sides. This results in a 30% increase of light reaching the ground.

What is claimed is:

1. An LED light fixture with a top side and a bottom side, comprising:

a light fixture body comprised of a heat sink ring with outwardly radiating fins;

an attachment means for attaching said light fixture body to a mounting surface;

said fixture body with an inside surface of the heat sink ring comprised of a number of sloped planar facets, for attachment of LED arrays to said facets, the facets sloped to direct light down from said fixture when said fixture is mounted overhead;

a plurality of LED arrays attached to said inside surface on said sloped planar facets;

a reflector dish attached to said fixture body, configured to direct light from said LED arrays toward a diffuser lens attached to the lower side of said heat sink ring, with said reflector dish mounted to intercept, reflect and redirect approximately 25-35% of light from said LED arrays; and a diffuser lens attached to said light fixture below said LED arrays, for diffusing light from said LED arrays and from said reflector dish;

in which said LED arrays have a light spread of approximately 60 degrees above the perpendicular plane of said LED array, and 60 degrees below the perpendicular plane of said LED array, with said reflector positioned to intercept, reflect and redirect approximately 25-35% of light from said LED arrays, by reflecting and redirecting most of the light from the 60 degrees of said LED array light spread above the perpendicular plane of the LED array.

2. The LED light fixture of claim 1 in which said LED arrays are comprised of banks of multiple LED arrays.

3. The light fixture of claim 1 in which said reflector dish is comprised of a convex dish, extending away from said top side.

4. The light fixture of claim 1 in which said reflector dish is comprised of a plurality of flat generally rectangular reflectors in front of each LED array.

5. The lighting fixture as recited in claim 1 which further comprises generally wedge shaped inserts for placement between the sloped planar facets of said heat sink ring and said LED arrays, for changing an angle of light pathways.

6. The lighting fixture of claim 5 in which said inserts change an LED pathway angle by approximately 20 to 70 degrees from vertical.

7. An LED light fixture with a top side and a bottom side, comprising:

a light fixture body comprised of a heat sink ring with outwardly radiating fins;

an attachment means for attaching said light fixture body to a mounting position;

said fixture body with an inside surface of the heat sink ring comprised of a number of sloped planar facets;

a plurality of LED arrays, attached to said inside surface on said sloped planar facets, with said LED arrays having a light spread of approximately 60 degrees above the perpendicular plane of said LED arrays and 60 degrees below the perpendicular plane of said LED arrays, with a reflector dish positioned to intercept, reflect and redirect approximately 25-35% of light from said LEDs, by reflecting and redirecting light from the 60 degrees of said LED light spread above the perpendicular plane of said LED;

a reflector dish attached to said fixture body, comprised of a plurality of generally rectangular flat reflectors forming an edge to an inverted pan, said pan having a central portion and a sloping edge made up of said flat reflectors, with said flat reflectors set at an angle to said LED arrays of between 15 to 40 degrees, and with said reflector dish configured to direct light from said LEDs toward a diffuser lens attached to a lower side of said heat sink ring, with said reflector dish mounted to intercept, reflect and redirect approximately 25-35% of light from said LED arrays; and a diffuser lens attached to said light fixture below said LED arrays, for diffusing light from said LED arrays and from said reflector dish.

8. The lighting fixture as recited in claim 7 which further comprises generally wedge shaped inserts for placement between the sloped planar facets of said heat sink ring and said LED arrays, for changing an angle of light pathways.

9. The lighting fixture of claim 8 in which said inserts change an LED pathway angle by approximately 20 to 70 degrees from vertical.

10. The lighting fixture of claim 7 in which said reflector dish rectangular flat reflectors change an LED pathway angle by approximately 10 to 60 degrees from vertical.

11. An LED light fixture with a top side and a bottom side, comprising:

a light fixture body comprised of a heat sink ring with outwardly radiating fins;

an attachment means for attaching said light fixture body to a mounting position;

said fixture body with an inside surface of the heat sink ring comprised of a number of sloped planar facets;

a plurality of LED arrays, attached to said inside surface on said sloped planar facets, with said LEDs having a light spread of approximately 60 degrees above the perpendicular plane of said LED arrays and 60 degrees below the perpendicular plane of said LED arrays, with a reflector dish positioned to block, reflect and redirect approximately 25-35% of light from said LEDs, by reflecting and redirecting light from the 60 degrees of said LED light spread above the perpendicular plane of said LED;

a reflector dish attached to said fixture body, comprised of a plurality of generally rectangular flat reflectors forming an edge to an inverted pan, said pan having a central portion and a sloping edge made up of said flat reflectors, with said flat reflectors set at an angle to said LED arrays of between 20 and 30 degrees, and with said reflector dish configured to direct light from said LEDs toward a diffuser lens attached to a lower side of said heat sink ring, with said reflector dish mounted to intercept, reflect and redirect approximately 25-35% of light from said LEDs; and a diffuser lens attached to said light fixture below said LED arrays, for diffusing light from said LEDs and from said reflector dish.

12. The lighting fixture as recited in claim 11 which further comprises generally wedge shaped inserts for placement between the sloped planar facets of said heat sink ring and said LED arrays, for changing an angle of light pathways.

13. The lighting fixture of claim 11 in which said inserts change an LED pathway angle by approximately 20 to 70 degrees from vertical.

* * * * *